US009638026B2

(12) United States Patent
Andersen et al.

(10) Patent No.: US 9,638,026 B2
(45) Date of Patent: May 2, 2017

(54) DOWNHOLE TOOL

(71) Applicant: WELLTEC A/S, Allerød (DK)

(72) Inventors: Tomas Sune Andersen, Helsingør (DK); Brian Engelbricht Thomsen, Frederikssund (DK)

(73) Assignee: WELLTEC A/S, Allerød (DK)

( * ) Notice: Subject to any disclaimer, the term of this patent is extended or adjusted under 35 U.S.C. 154(b) by 0 days.

(21) Appl. No.: 14/912,769

(22) PCT Filed: Sep. 3, 2014

(86) PCT No.: PCT/EP2014/068689
§ 371 (c)(1),
(2) Date: Feb. 18, 2016

(87) PCT Pub. No.: WO2015/032796
PCT Pub. Date: Mar. 12, 2015

(65) Prior Publication Data

US 2016/0201456 A1 Jul. 14, 2016

(30) Foreign Application Priority Data

Sep. 3, 2013 (EP) ..... 13182843

(51) Int. Cl.
*E21B 47/18* (2012.01)
*E21B 47/12* (2012.01)
*E21B 47/14* (2006.01)

(52) U.S. Cl.
CPC ..... *E21B 47/12* (2013.01); *E21B 47/14* (2013.01); *E21B 47/18* (2013.01)

(58) Field of Classification Search
CPC ..... E21B 47/12; E21B 47/14; E21B 47/18
(Continued)

(56) References Cited

U.S. PATENT DOCUMENTS 4,208,966 A * 6/1980 Hart ..... F42D 1/055 102/310
5,115,880 A * 5/1992 Sallas ..... G01V 1/02 181/106

(Continued)

FOREIGN PATENT DOCUMENTS

| | | |
|---|---|---|
| EP | 2 463 478 | 6/2012 |
| GB | 2 451 165 | 1/2009 |
| WO | WO 2011/100315 | 8/2011 |

OTHER PUBLICATIONS

Notification Concerning Transmittal of International Preliminary Report on Patentability (Chapter I of the Patent Cooperation Treaty) dated Mar. 17, 2016 issued in International Application No. PCT/EP2014/068689 (9 pages).

(Continued)

*Primary Examiner* — Ojiako Nwugo
(74) *Attorney, Agent, or Firm* — Nixon & Vanderhye P.C.

(57) ABSTRACT

The present invention relates to a downhole tool (10) to be submerged into a well fluid from a top of a well, comprising a first tool section (21), a tool housing (3) having an inner face (4), a downhole communication module (1) for communicating through a well fluid in a downhole well to operate the downhole tool, comprising a piezoelectric transceiver (5) having a first face (6) and a second face (7) and being arranged in the tool housing, wherein an element (8) is arranged between the piezoelectric transceiver and the tool housing, and the element is arranged in abutment with the first face of the piezoelectric transceiver and the inner face of the housing, so that the tool housing acts as a transducer when the piezoelectric transceiver is activated and enlarges in a radial direction of the tool housing, forcing the tool housing outwards and sending a signal through the well fluid. The present invention also relates to a downhole system and a communication method.

20 Claims, 8 Drawing Sheets

(58) Field of Classification Search
USPC ..... 367/83–85
See application file for complete search history.

(56) References Cited

U.S. PATENT DOCUMENTS 5,165,653 A * 11/1992 Weber ..... F15B 7/10 137/625.65
6,046,685 A * 4/2000 Tubel ..... E21B 23/03 137/606
6,247,533 B1 * 6/2001 Brett ..... E21B 28/00 166/104
2008/0170466 A1 * 7/2008 Mickael ..... G01V 1/50 367/25
2009/0022011 A1 * 1/2009 Mickael ..... G01V 1/52 367/81
2009/0297372 A1 * 12/2009 Amirouche ..... F04B 43/046 417/413.2
2010/0127599 A1 * 5/2010 Thuerlemann ..... B06B 3/00 310/323.18
2010/0165788 A1 * 7/2010 Rayssiguier ..... G01V 1/16 367/25
2011/0149687 A1 * 6/2011 Rayssiguier ..... E21B 47/011 367/82
2011/0192222 A1 * 8/2011 Vetter ..... E21B 47/0005 73/152.58
2012/0163131 A1 * 6/2012 Kennedy ..... B06B 1/0611 367/157
2012/0286967 A1 * 11/2012 Alteirac ..... E21B 47/12 340/853.7

OTHER PUBLICATIONS

International Search Report and Written Opinion of the ISA for PCT/EP2014/068689, mailed Feb. 16, 2015, 13 pages.

* cited by examiner

DOWNHOLE TOOL

This application is the U.S. national phase of International Application No. PCT/EP2014/068689 filed 3 Sep. 2014, which designated the U.S. and claims priority to EP Patent Application No. 13182843.6 filed 3 Sep. 2013, the entire contents of each of which are hereby incorporated by reference.

FIELD OF THE INVENTION

The present invention relates to a downhole tool comprising a downhole communication module for communicating through a well fluid in a downhole well to operate the downhole tool. The present invention also relates to a downhole system and a communication method.

BACKGROUND ART

Communication between surface and a tool in a well via acoustic signals or antennae in the well fluid is known. However, well fluid is most often very inhomogeneous as it comprises mud, scales, both oil and water, and gas bubbles. Therefore, the communication sometimes fails.

Sometimes, two operators work together to perform a well operation in the sense that a tool of one operator is arranged between the tools of another operator. However, when this is the case, communication between the tools of the other operator is prevented as these tools are separated by the tool of one operator, through which communication is not possible. This is due to the fact that one operator uses a different communication system than the other operator and that it is not possible to pull wires through the intermediate tool.

Since prior art antenna or acoustic communication through well fluid does not always function successfully, there is a need for an alternative communication form.

SUMMARY OF THE INVENTION

It is an object of the present invention to wholly or partly overcome the above disadvantages and drawbacks of the prior art. More specifically, it is an object to provide an improved communication unit providing successful communication between two tools separated by an intermediate tool.

The above objects, together with numerous other objects, advantages and features, which will become evident from the below description, are accomplished by a solution in accordance with the present invention by a downhole tool to be submerged into a well fluid from a top of a well, comprising:

- a first tool section,
- a tool housing having an inner face, and
- a downhole communication module for communicating through a well fluid in a downhole well to operate the downhole tool, comprising:
  - a piezoelectric transceiver having a first face and a second face and being arranged in the tool housing, and
  - an element, wherein the element is arranged between the piezoelectric transceiver and the tool housing, and the element is arranged in abutment with the first face of the piezoelectric transceiver and the inner face of the housing, so that the tool housing acts as a transducer when the piezoelectric transceiver is activated and enlarges in a radial direction of the tool housing, forcing the tool housing outwards and sending a signal through the well fluid.

By having the element arranged between the piezoelectric transceiver and the tool housing, the tool housing can act as a transducer when the piezoelectric transceiver is activated and enlarges in a radial direction of the tool housing, forcing the tool housing outwards. Hereby, it is possible to send and receive a more powerful signal through the well fluid over a third-party tool, which is not possible by means of known transducers.

Furthermore, the communication module may be enclosed in the tool housing, providing a more stable communication, and the communication module may be firmly sealed from the well fluid. The known transducers are arranged in a cavity in the tool housing, resulting in a problematic sealing when the tool is in use.

The element may be a resonator.

The tool housing may enlarge along with the piezoelectric transceiver in the radial direction.

Moreover, the element and the piezoelectric transceiver may be locked in the radial direction by the tool housing.

Also, the signal may be transmitted at an eigenfrequency of the piezoelectric transceiver and the element.

Furthermore, the signal may be transmitted and/or received at a frequency of 30-50 kHz.

Alternatively, the signal may be transmitted and/or received at a frequency of 25-70 kHz, preferably 30-50 kHz, more preferably 35-45 kHz.

Further, the piezoelectric transceiver may be a piezoceramic element.

Moreover, the element may have a base part and a movable part.

The movable part may be arranged facing the inner face of the housing.

Also, the movable part may be arranged abutting the inner face of the tool housing.

Additionally, the movable part may have a shape that corresponds to the inner face of the housing.

Moreover, the movable part may be adapted to move in a springy manner in relation to the base part.

Additionally, the movable part may have a leaf shape, such as a leaf spring.

Such leaf spring may be projecting from the base part.

Furthermore, the leaf spring may be designed to adjust the element to conform to the eigenfrequency of the piezoelectric transceiver and the element.

The downhole tool as described above may further comprise a second element arranged to abut the second face of the piezoelectric transceiver and the inner face of the housing.

Also, the first and the second elements may be connected by means of bolts or screws and the bolts or screws function as a spring so that the elements are still capable of moving radially outwards.

The bolts or screws may form part of the spring ability of a system of element(s) and transceiver(s).

Also, the downhole tool as described above may further comprise a second piezoelectric transceiver arranged between the second face and the second element.

Furthermore, the downhole tool as described above may comprise a conductive means for electrically connecting the piezoelectric transceiver with a control unit adapted to activate the piezoelectric transceiver.

Moreover, the elements may be connected by means of a connection means, such as a bolt.

The conductive means may be a sheet arranged to abut the second face.

In addition, the conductive means may be a sheet arranged between the piezoelectric transceivers.

Also, the housing may have a cylindrical shape.

Further, the element(s) may have a crescent cross-sectional shape.

The movable part may have a curved shape so as to conform with the inner face.

Moreover, the first tool section may be electrically connected with the downhole tool as described above for communicating wirelessly to another tool and/or to the top of the well through the well fluid.

The downhole tool as described above may further comprise a second tool section.

Said second tool section may comprise a second downhole communication module.

Also, the second tool section may be electrically connected with a second downhole communication module.

Moreover, the second tool section may be connected with a wireline.

Also, the downhole tool as described above may further comprise a third tool section arranged between the first tool section and the second tool section.

Further, the first and the second elements and the piezoelectric transceiver may be arranged in the tool housing and locked in the radial direction by the tool housing.

The present invention also relates to a downhole system comprising:

a casing comprising a well fluid, and a downhole tool as described above, wherein the downhole tool is arranged in the well fluid.

Finally, the present invention relates to a communication method for communicating from a downhole tool to another downhole tool or to a top of a well having well fluid, comprising the steps of:

submerging the downhole tool as described above into the well fluid, transmitting the signal or a plurality of signals from the downhole communication module into the well fluid, and receiving the signal or plurality of signals via the well fluid.

The signal may be transmitted at an eigenfrequency of the piezoelectric transceiver and the element.

Moreover, the signal may be transmitted and/or received at a frequency of 30-50 kHz.

Also, the signal may be transmitted and/or received at a frequency of 25-70 kHz, preferably 30-50 kHz, more preferably 35-45 kHz.

The tool housing may act as a transducer when the piezoelectric transceiver is activated and enlarges in a radial direction of the tool housing, forcing the tool housing outwards and sending a signal through the well fluid.

Further, the tool housing may enlarge along with the piezoelectric transceiver in the radial direction.

In the communication method as described above, the downhole tool may comprise a first tool section, a second tool section and a third tool section, the third tool section being arranged between the first tool section and the second tool section, the first tool section being electrically connected with a first downhole communication module and the second tool section being electrically connected with a second downhole communication module, said communication method comprising the steps of:

transmitting a signal or a plurality of signals from the first downhole communication module into the well fluid, and receiving the signal or plurality of signals transmitted via the well fluid and past the third tool section by the second downhole communication module.

BRIEF DESCRIPTION OF THE DRAWINGS

The invention and its many advantages will be described in more detail below with reference to the accompanying schematic drawings, which for the purpose of illustration show some non-limiting embodiments and in which.

All the figures are highly schematic and not necessarily to scale, and they show only those parts which are necessary in order to elucidate the invention, other parts being omitted or merely suggested.

DETAILED DESCRIPTION OF THE INVENTION

Figure 1:
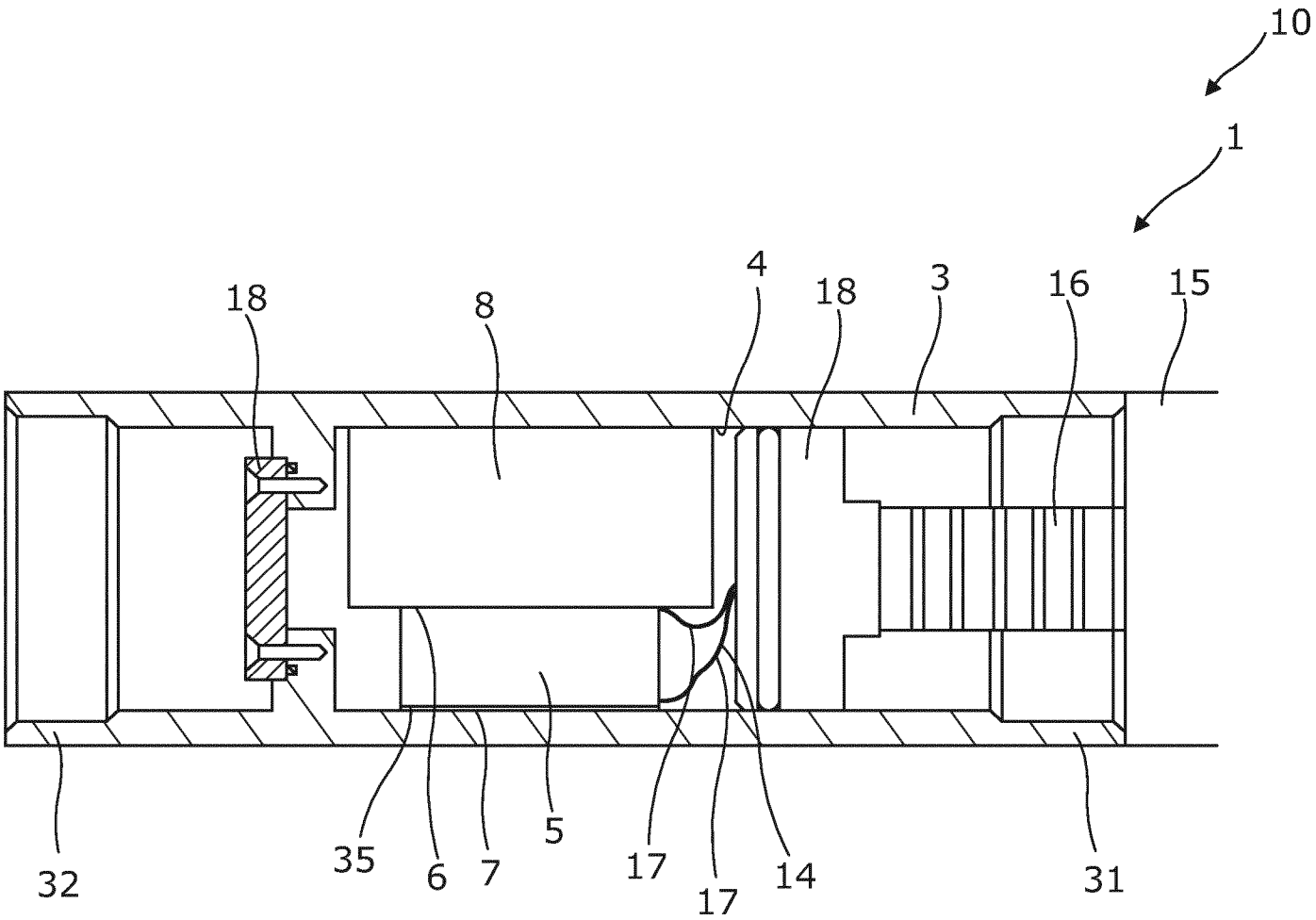
FIG. 1 shows a partial, cross-sectional view of a downhole communication module in a downhole tool.

FIG. 1 shows a downhole tool 10 comprising a communication module 1 for communicating through a well fluid surrounding the module when it is in a downhole well. The downhole communication module 1 is used for operating other parts of the downhole tool and comprises a tool housing 3, a piezoelectric transceiver 5 arranged in the tool housing, and an element 8 arranged in the tool housing between the piezoelectric transceiver and the housing. The tool housing 3 has an inner face 4 and the piezoelectric transceiver 5 has a first face 6 and a second face 7, and the element is arranged in abutment with the first face of the piezoelectric transceiver and the inner face of the tool housing. The piezoelectric transceiver is electrically connected with a control unit 15 by means of conductive means 14. As the piezoelectric transceiver 5 is activated, it enlarges in the radial direction of the cylindrical tool housing, so that the element is forcing the housing outwards, sending a signal through the well fluid, e.g. to another tool which is not wirelessly connected with the communication module. In the same way, the piezoelectric transceiver 5 is capable of sensing signals sent through the well fluid from another communication module, since the piezoelectric transceiver 5 generates voltage depending on its compression.

When intervening a well, two operators of tools often cooperate to be able to perform the requested operation. In this way, a tool section of one operator may have to be arranged between the tool sections of another operator. However, when this is the case, communication between the tool sections of one operator is prevented as these tools are separated by the tool of the other operator, through which communication is not possible. This is due to the fact that one operator may use a different communication system than the other operator and that it is not possible to pull wires through the intermediate tool section without having to substantially redesign the tools.

In FIG. 1, the conductive means is shown as electrical wires 17 coupled to a connection part 16 of the control unit 15. The control unit activates the piezoelectric transceiver so that it sends a short or long signal at a certain frequency to a piezoelectric transmitter/receiver or transceiver picking up the signal. The piezoelectric transceiver is adapted to both sending and receiving signals. The signals are usually sent at a certain frequency so that the receiver is adjusted to focus to detect signals at that frequency. The signals are sent as longer or shorter signals, so that control signals can be sent to a tool section over a third party tool from another tool section without communication wires going through the third party tool. The signals may also be data, e.g. from a logging tool. The housing is closed from each end by end connectors 18, where the conductive means is allowed to pass in one of the end connectors to the control unit 15.

Figure 2:
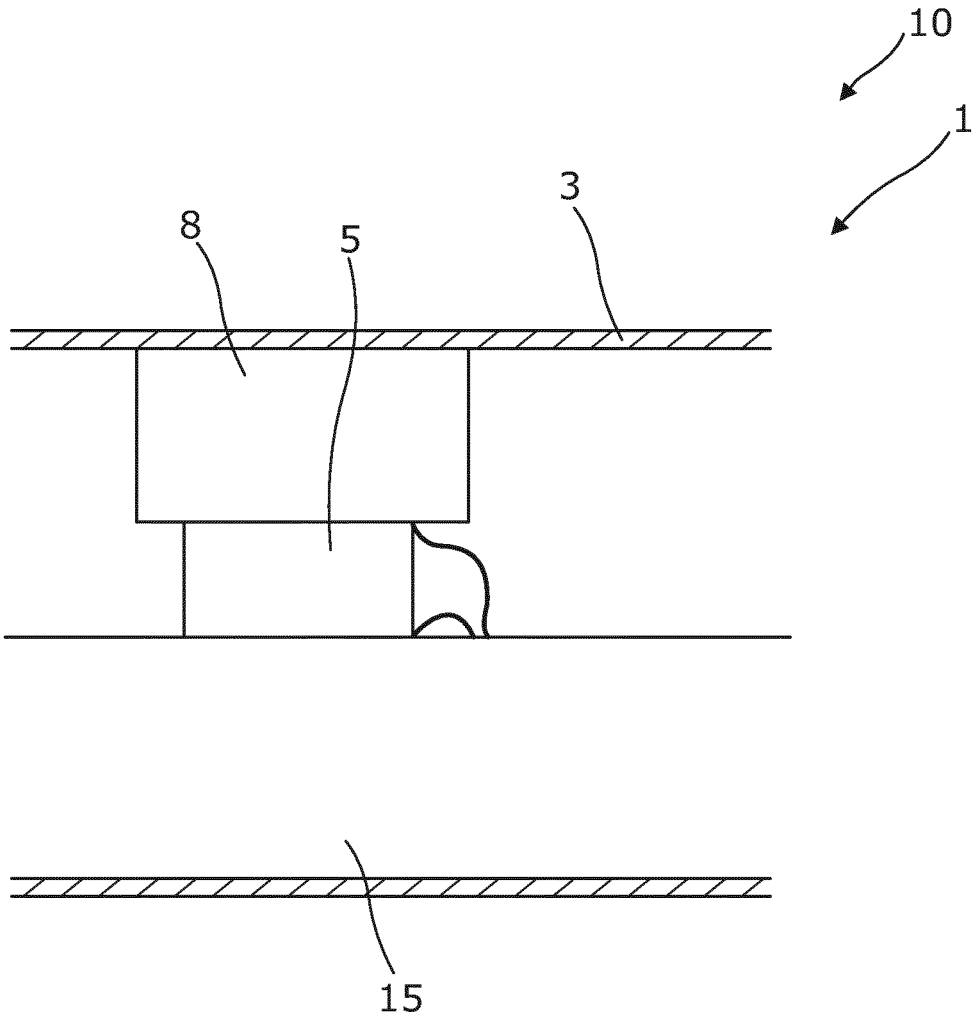
FIG. 2 shows a partial, cross-sectional view of another downhole communication module.

In FIG. 1, the element and the piezoelectric transceiver together fill up the inside of the housing along the inner diameter of the housing and is locked in the housing, and a spring 35, such as a leaf spring, is arranged between the piezoelectric transceiver 5 and the housing to provide a certain amount of tension to the piezoelectric system. The piezoelectric system comprises the element being the resonator and the piezoelectric transceiver. Thus, the element and the piezoelectric transceiver are locked in the radial direction by the tool housing, and the tool housing enlarges along with the piezoelectric transceiver in the radial direction. In FIG. 2, the control unit is arranged between the piezoelectric transceiver and the housing along the diameter of the housing.

The signal is transmitted and/or received at an eigenfrequency of the piezoelectric transceiver and the element, and the element is so designed that it conforms to the eigenfrequency of the piezoelectric transceiver and the element. The signal is transmitted and/or received at a frequency of 25-70 kHz, preferably 30-50 kHz, more preferably 35-45 kHz. Thus, the element is designed so that the piezoelectric system comprising the element and the piezoelectric transceiver is able to oscillate at the eigenfrequency of the piezoelectric system. The resonance frequency is the eigenfrequency of the piezoelectric transceiver and the element.

The leaf spring is further designed to adjust the element to conform to the eigenfrequency of the piezoelectric transceiver and the element. The transistion between the movable part, being the leaf spring, and the base part of the element may be designed to bespringy, so that the tool housing oscillate but the effect on the frequency is minimised.

Figure 3:
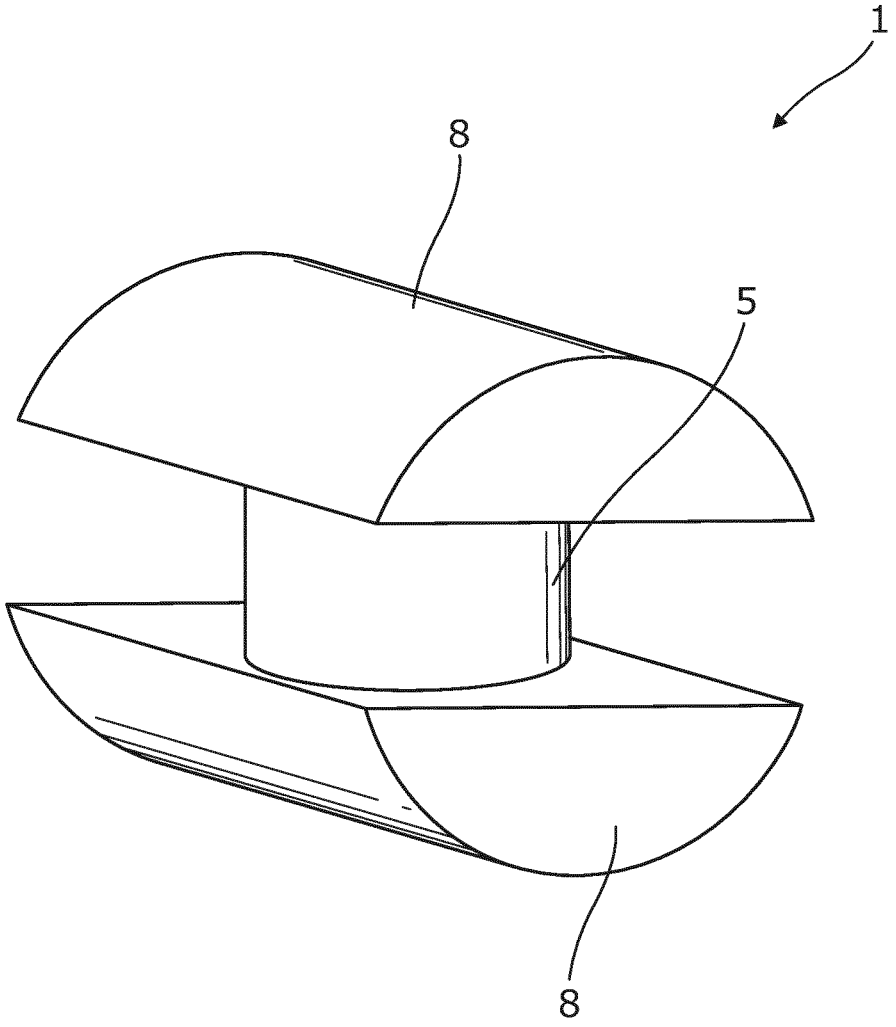
FIG. 3 shows, in perspective, two elements and a piezoelectric transceiver of a downhole communication module.

As shown in FIG. 3, the downhole communication module comprises two elements, that is a first and a second element. The second element is arranged on the other side of the piezoelectric transceiver than the first element, so that the first element abuts the first face of the piezoelectric transceiver and the second element abuts the second face of the piezoelectric transceiver 5. The piezoelectric system thus comprises the first and second elements and the piezoelectric transceiver which are all arranged in the housing, so that oscillations in the piezoelectric system results in oscillations of the tool housing.

Figure 4:
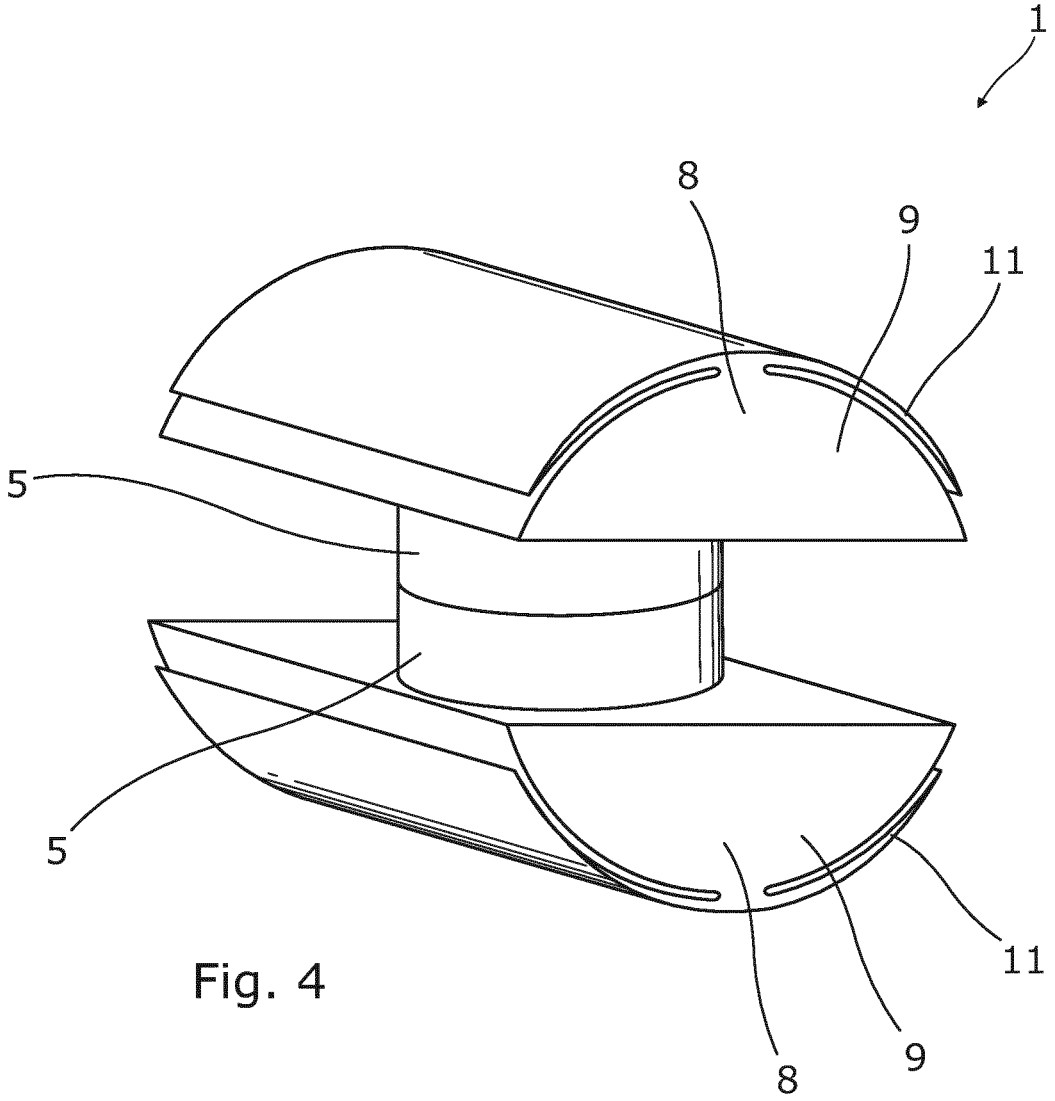
FIG. 4 shows, in perspective, two other elements and a piezoelectric transceiver.
Figure 5:
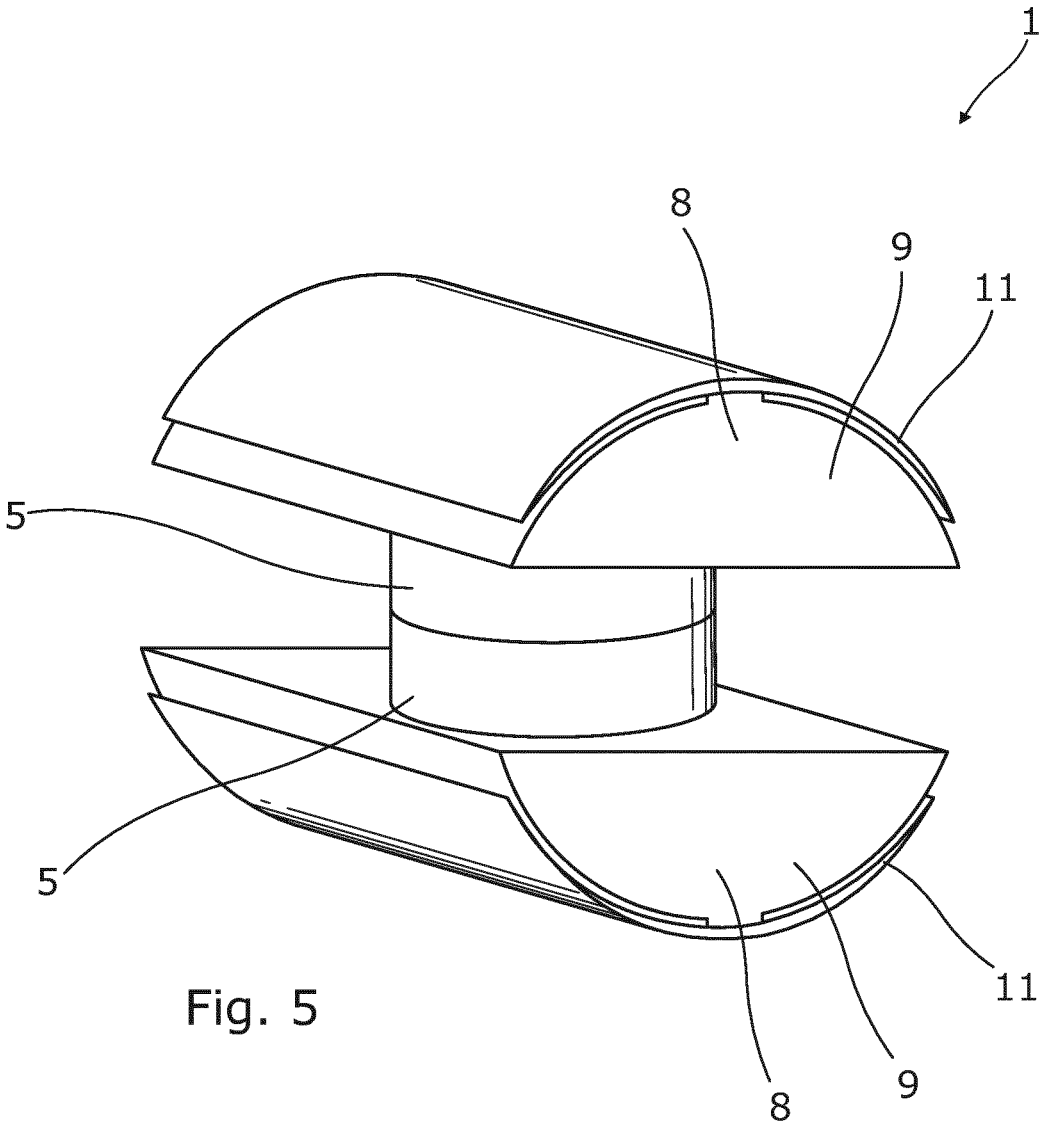
FIG. 5 shows, in perspective, two other elements and a piezoelectric transceiver.

In FIG. 4, each element has a crescent cross-sectional shape and has a base part 9 and a movable part 11, where the movable part is arranged facing the inner face of the housing (not shown in FIG. 4). The movable part thus has a shape that corresponds to the inner face of the housing and is adapted to move in a springy manner in relation to the base part of the element, so that when the elements and the piezoelectric transceiver are arranged in the housing, the movable part is somewhat bent for the elements to fit inside the housing. The movable part has the shape of a leaf and acts in the same manner as a leaf spring. As shown in FIG. 5, the leaf-shaped movable part may be a leaf spring connected with the base part of the element. When the elements and the piezoelectric transceivers are arranged in the housing, the movable part is bent providing a pre-tensioning of the piezoelectric system of elements and transceivers.

In FIGS. 4 and 5, the downhole communication module 1 comprises a second piezoelectric transceiver 5 arranged between the second face of the first piezoelectric transceiver and the second element. By having two piezoelectric transceivers, the communication with the downhole communication module becomes more accurate than when only having one piezoelectric transceiver.

By the element comprising movable parts and a base part, the eigenfrequency of the system is easier to obtain and thus provides a more accurate, fast and successful communication. In the system of FIGS. 4 and 5, i.e. the elements and the transceivers, both elements move outwards as the piezoelectric transceiver is activated (transmitting) or inwards when the elements is receiving signals through the well fluid.

Figure 6:
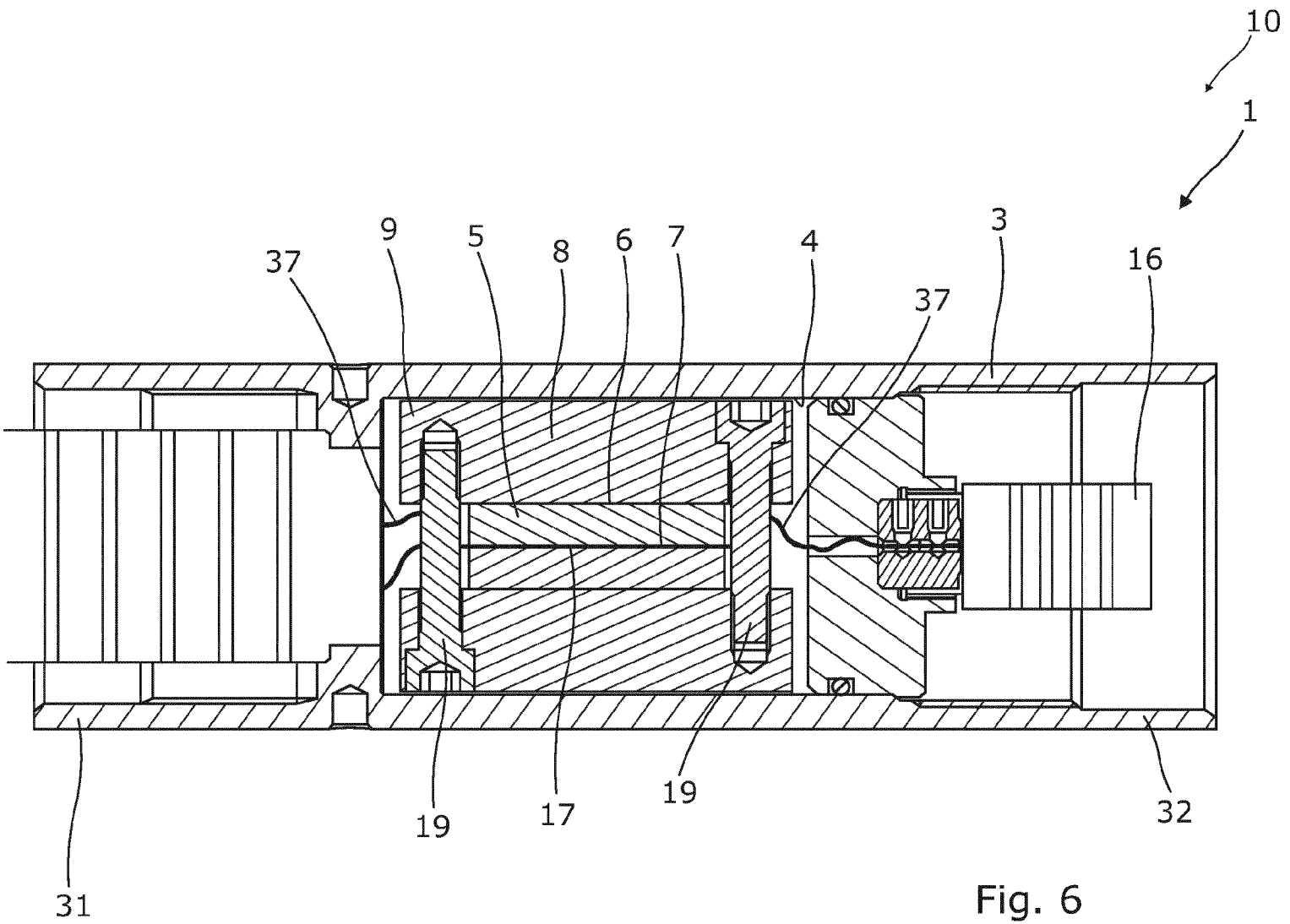
FIG. 6 shows a partial, cross-sectional view of another downhole communication module.

In FIG. 6, the elements 8 are connected by means of a connection means 19, such as a bolt or a screw, and the bolts form part of the spring ability of the system of elements 8 and transceivers 5. The movable parts in the form of leaf-shaped arms may still move more freely than the base part of the elements. The conductive means 14 is a sheet, such as a copper sheet, arranged to abut the second face of the piezoelectric transceivers and thus squeezed in between the transceivers to activate the transceivers or conduct electricity when the transceivers are moved by means of the signals in the well fluid. Thus, the tool housing functions as a transducer. The tool housing has a first end 31 which is connectable to other parts of the downhole tool and forms part of the same, and a second end 32 which is connectable to a "third party tool" (as shown in FIG. 3) or constitutes the end of the downhole tool (as shown in FIG. 1). Wires, cords or cables 37 may be arranged to run through the downhole communication module 1 from the downhole tool 10 to the third party tool which is connectable to the second end 32 through the connection part 16, so that the third party tool receives power and/or communicates through the tool section 22 closest to the top of the well (as shown in FIG. 8).

Figure 7:
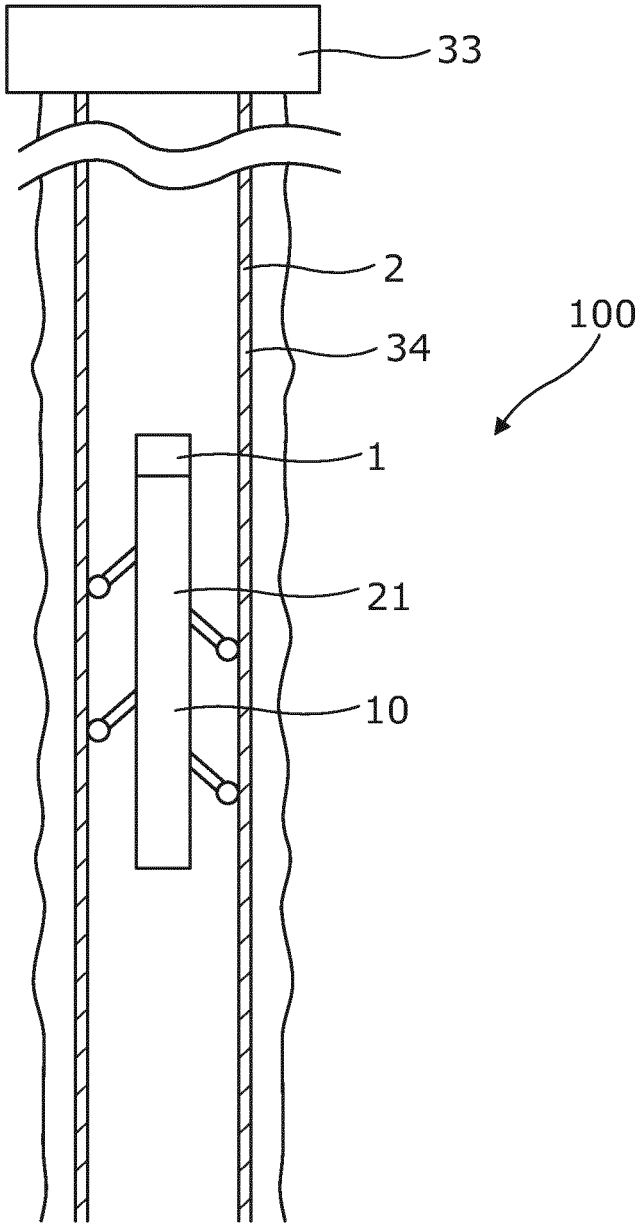
FIG. 7 shows a downhole tool in a downhole system.

The downhole communication module 1 is thus connectable with a tool section of the downhole tool 10 as shown in FIG. 7. The downhole tool is submerged into the well fluid from a top 33 of a well 2. The tool comprises a first tool section 21 which is electrically connected with the downhole communication module 1 for communicating wirelessly to another tool further up or down the well or to the top of the well through the well fluid. The tool section may be any kind of tool, such as a driving unit, a logging unit, an operational tool, etc.

Figure 8:
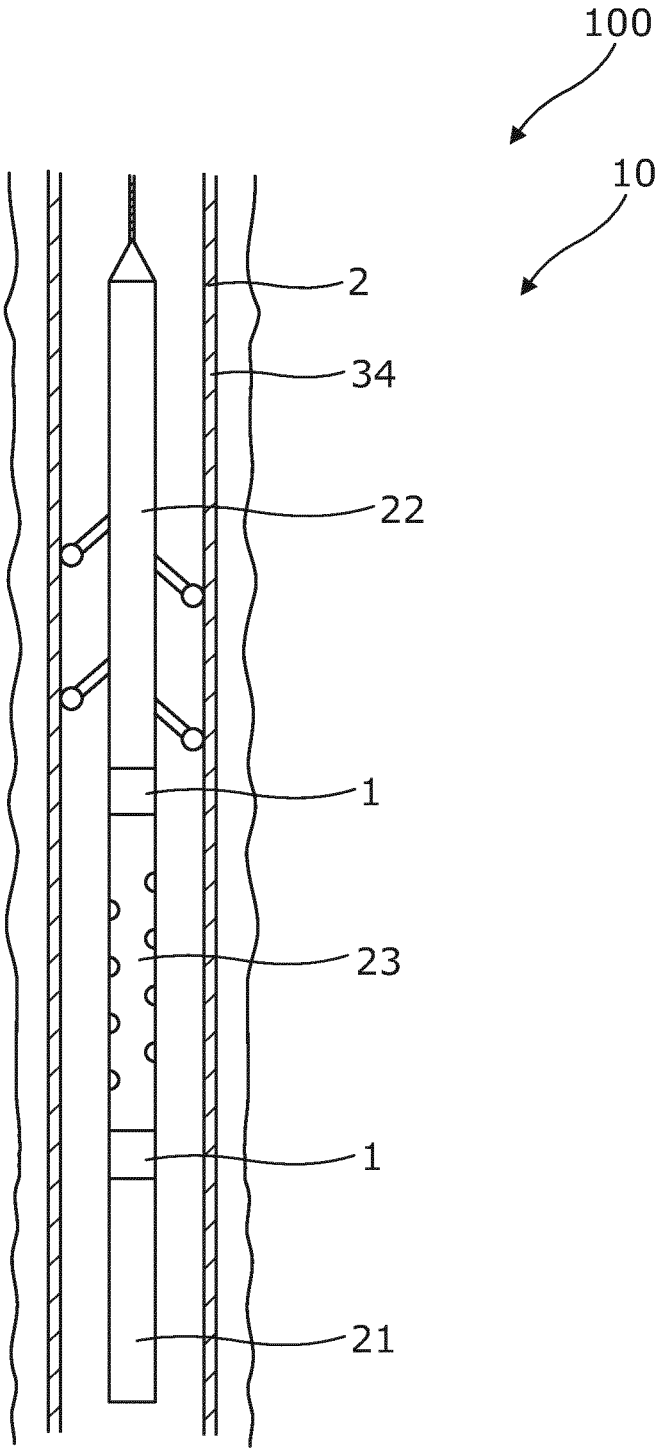
FIG. 8 shows another downhole tool in a downhole system.

As shown in FIG. 8, the downhole tool 10 further comprises a second tool section 22 which is electrically connected with a second downhole communication module 1. A so-called "third party tool" being a third tool is arranged between the first tool section and the second tool section. The second tool section is connected with and powered through a wireline and is able to receive control signals from surface through the wireline. The second tool is thus able to send such signals further down the well to the first tool section by means of the first and second downhole communication modules 1 through the well fluid and without use of communication wires in the "third party tool". Often, as shown, the first tool section 21 arranged furthest away from the top is an operational tool, such as a milling tool, a key tool, or a lateral locator tool, and the second tool is a driving unit and/or a logging unit.

The downhole system 100 shown in FIGS. 7 and 8 comprises the casing 34 comprising a well fluid and the above-mentioned downhole tool 10 comprising one or more of the downhole communication modules 1.

The invention also relates to a communication method for communicating from a downhole tool to another downhole tool or to a top of a well having well fluid. The communication method comprises the step of submerging the downhole tool into the well fluid, the downhole tool comprising the downhole communication module. After submerging the downhole tool into the well fluid, a signal or a plurality of signals is transmitted from the downhole communication module into the well fluid, and the signal or plurality of signals is received via the well fluid, for instance by another downhole communication module.

Furthermore, when the downhole tool comprises a first tool section, a second tool section and a third tool section, the third tool section being arranged between the first tool section and the second tool section, the first tool section is electrically connected with a first downhole communication module and the second tool section is electrically connected with a second downhole communication module. Then the signal or plurality of signals is transmitted from the first downhole communication module into the well fluid, and the signal or plurality of signals transmitted via the well fluid and past the third tool section is received by the second downhole communication module.

By fluid or well fluid is meant any kind of fluid that may be present in oil or gas wells downhole, such as natural gas, oil, oil mud, crude oil, water, etc. By gas is meant any kind of gas composition present in a well, completion, or open hole, and by oil is meant any kind of oil composition, such as crude oil, an oil-containing fluid, etc. Gas, oil, and water fluids may thus all comprise other elements or substances than gas, oil, and/or water, respectively.

By a casing is meant any kind of pipe, tubing, tubular, liner, string etc. used downhole in relation to oil or natural gas production.

In the event that the tool is not submergible all the way into the casing, a downhole tractor can be used to push the tool all the way into position in the well. The downhole tractor may have projectable arms having wheels, wherein the wheels contact the inner surface of the casing for propelling the tractor and the tool forward in the casing. A downhole tractor is any kind of driving tool capable of pushing or pulling tools in a well downhole, such as a Well Tractor®.

Although the invention has been described in the above in connection with preferred embodiments of the invention, it will be evident for a person skilled in the art that several modifications are conceivable without departing from the invention as defined by the following claims.

The invention claimed is:

1. A downhole tool to be submerged into a well fluid from a top of a well, comprising:

a first tool section, and a tool housing movable downhole in the well, the tool housing having an inner face, a downhole communication module for communicating through a well fluid in the well to operate the downhole tool, comprising:

a piezoelectric transceiver having a first face and a second face and being arranged in the tool housing, and an element, wherein the element is arranged between the piezoelectric transceiver and the tool housing, and the element is arranged in abutment with the first face of the piezoelectric transceiver and the inner face of the housing, so that the tool housing acts as a transducer when the piezoelectric transceiver is activated and enlarges in a radial direction of the tool housing, forcing the tool housing outwards and sending a signal through the well fluid.

2. A downhole tool according to claim 1, wherein the tool housing enlarges along with the piezoelectric transceiver in the radial direction.

3. A downhole tool according to claim 1, wherein the element and the piezoelectric transceiver are locked in the radial direction by the tool housing.

4. A downhole tool according to claim 1, wherein the signal is transmitted at an eigenfrequency of the piezoelectric transceiver and the element.

5. A downhole tool according to claim 1, wherein the signal is transmitted and/or received at a frequency of 30-50 kHz.

6. A downhole tool according to claim 1, wherein the element has a base part and a movable part.

7. A downhole tool according to claim 6, wherein the movable part is arranged facing the inner face of the housing.

8. A downhole tool according to claim 6, wherein the movable part is arranged abutting the inner face of the tool housing.

9. A downhole tool according to claim 1, further comprising a second element arranged to abut the second face of the piezoelectric transceiver and the inner face of the housing.

10. A downhole tool according to claim 9, wherein the first and the second elements are connected by means of bolts or screws and the bolts or screws function as a spring so that the elements are still capable of moving radially outwards.

11. A downhole tool according to claim 1, wherein the first tool section is electrically connected with the downhole tool for communicating wirelessly to another tool and/or to the top of the well through the well fluid.

12. A downhole tool according to claim 1, further comprising a third tool section arranged between the first tool section and a second tool section.

13. A downhole tool according to claim 9, wherein the first and the second elements and the piezoelectric transceiver are arranged in the tool housing and locked in the radial direction by the tool housing.

14. A downhole system comprising:

a casing comprising a well fluid, and a downhole tool according to claim 1 wherein the downhole tool is arranged in the well fluid.

15. A communication method for communicating from a downhole tool to another downhole tool or to a top of a well having well fluid, comprising the steps of:

submerging the downhole tool according to claim 1 into the well fluid, transmitting the signal or a plurality of signals from the downhole communication module into the well fluid, and receiving the signal or plurality of signals via the well fluid.

16. A communication method according to claim 15, wherein the signal is transmitted at an eigenfrequency of the piezoelectric transceiver and the element.

17. A communication method according to claim 15, wherein the signal is transmitted and/or received at a frequency of 30-50 kHz.

18. A communication method according to claim 15, wherein the tool housing acts as a transducer when the piezoelectric transceiver is activated and enlarges in a radial direction of the tool housing, forcing the tool housing outwards and sending a signal through the well fluid.

19. A communication method according to claim 15, wherein the tool housing enlarges along with the piezoelectric transceiver in the radial direction.

20. A communication method according to claim 15, wherein the downhole tool comprises a first tool section, a second tool section and a third tool section, the third tool section being arranged between the first tool section and the second tool section, the first tool section being electrically connected with a first downhole communication module and the second tool section being electrically connected with a second downhole communication module, said communication method comprising the steps of:

transmitting a signal or a plurality of signals from the first downhole communication module into the well fluid, and receiving the signal or plurality of signals transmitted via the well fluid and past the third tool section by the second downhole communication module.

* * * * *